US006220225B1

(12) United States Patent
Mencher et al.

(10) Patent No.: US 6,220,225 B1
(45) Date of Patent: Apr. 24, 2001

(54) ELECTRONIC CONTROL APPARATUS FOR FORMING A FUEL-METERING SIGNAL FOR AN INTERNAL COMBUSTION ENGINE DURING THE START AND POST-START PHASES THEREOF

(75) Inventors: Bernhard Mencher, Schwieberdingen; Gunter Mueller, Gerlingen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/385,423

(22) Filed: Aug. 30, 1999

(30) Foreign Application Priority Data

Aug. 31, 1998 (DE) ..... 198 39 555

(51) Int. Cl.[7] ..... F02D 41/06
(52) U.S. Cl. ..... 123/491
(58) Field of Search ..... 123/491, 179.16

(56) References Cited

U.S. PATENT DOCUMENTS 4,089,317 5/1978 Drews et al. ..... 123/179.17
4,143,621 3/1979 Long ..... 123/491
5,215,062 * 6/1993 Asano et al. ..... 123/491
5,497,752 * 3/1996 Sagisaka et al. ..... 123/491
5,690,074 11/1997 Ogawa ..... 123/491

FOREIGN PATENT DOCUMENTS 0843086 5/1998 (EP) .
2290392 12/1995 (GB) .
8-49584 * 2/1996 (JP) .

* cited by examiner

*Primary Examiner*—Andrew M. Dolinar
(74) *Attorney, Agent, or Firm*—Walter Ottesen

(57) ABSTRACT

The invention is directed to an electronic control apparatus for forming a fuel-metering signal for an internal combustion engine wherein increased fuel metering occurs during the start and post-start phases of the engine. With the electronic control apparatus, an index is formed for the pressure in the intake manifold of the engine and the gradient of the index is formed. The increased metering of fuel is reduced in dependence upon the gradient.

7 Claims, 4 Drawing Sheets

ELECTRONIC CONTROL APPARATUS FOR FORMING A FUEL-METERING SIGNAL FOR AN INTERNAL COMBUSTION ENGINE DURING THE START AND POST-START PHASES THEREOF

FIELD OF THE INVENTION

The invention relates to the formation of a fuel-metering signal during and after the start of an internal combustion engine having intake manifold injection.

BACKGROUND OF THE INVENTION

Start and post-start corrections in the formation of a fuel-metering signal are known, for example, from U.S. Pat. No. 4,089,317 and are controlled downwardly, that is, the corrections are successively switched off.

The necessity of the start and post-start corrections results from the fuel storage characteristic of the intake manifold. More specifically, injected fuel partially condenses to form a wall film of fuel which adheres to the wall of the intake manifold. Low temperatures and high induction pressures favor the condensation and high temperatures and low intake manifold pressures favor the vaporization of the fuel from the wall film.

The condensation effects a reduction of the fuel quantity inducted into the combustion chamber of the engine. The vaporization increases this quantity. For a cold engine after a start, the influence of the condensation is, as a rule, preponderant which, for example, can be compensated by an increase in the fuel-injection pulsewidth. Basic investigations as to the fuel storage characteristic of wall films are presented, for example, in the article published in SAE Paper 810494.

In addition, a transition compensation UK is used in modern engine controls. This compensation is intended to compensate for the influence of wall film effects on the mixture composition in the combustion chamber during transition between different operating states. Thus, when the throttle flap is opened, an increase of the wall film mass occurs and, when closing the throttle flap, a reduction of the wall film mass occurs.

The fuel metering is correspondingly additionally increased via the injection valves when opening the throttle flap and is greatly reduced when closing the throttle flap in order to compensate for the effect of the fuel flow from the wall film.

This transition compensation is matched to the operationally-warm engine. It has been shown that, in known engine controls, unwanted large incorrect mixture adaptations occur in the time range of the first seconds after a start.

Thus, also significant overenrichment of the air/fuel mixture has been observed under the influence of an increase of the fuel-metering signals as a consequence of the start/post-start corrections under specific conditions.

SUMMARY OF THE INVENTION

It is an object of the invention to provide a further improvement of the fuel-metering signal formation during and after a start of the engine.

The electronic control apparatus of the invention is for forming a fuel-metering signal for an internal combustion engine wherein increased fuel metering occurs during and after a start of the engine. The electronic control apparatus includes: means for forming an index for the pressure in the intake manifold of the engine; means for forming the gradient of the index; and, means for reducing the increased metering of fuel in dependence upon the gradient.

The invention is based on the realization that the clear overenrichments are caused by an intense reduction of the wall film which, in turn, is determined by the gradient of the intake manifold pressure and supplementally by temperature influences.

Before the start of the engine, an ambient pressure of approximately 1,000 mbar is present in the combustion chambers at sea level. Typically, a pressure of approximately 300 mbar develops in the intake manifold in the stable idle of the engine.

This pressure drop permits fuel from the wall film, which is present, to vaporize. The rate of vaporization increases with an increasing pressure gradient and increasing wall film temperature and intake air temperature.

According to the invention, a correction is superposed on the start/post-start enrichment in the first seconds of the operation of the engine. This correction effects a multiplicative leaning and is dependent upon pressure gradient and temperature.

The teaching of the invention thereby considers the excessive reduction of wall film, which can occur after the start of an engine which is not quite cold and the large pressure gradients which occur. In this way, an intense overenrichment of the air/fuel mixture is advantageously countered for the hot start. This reduces, inter alia, the emission of uncombusted hydrocarbons and tends to reduce consumption.

Also advantageous is the continuous controlling down of the leaning correction after a start in order to prevent jumps in the torque as a consequence of an otherwise possible jump-like enrichment via the deactivation of the function.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
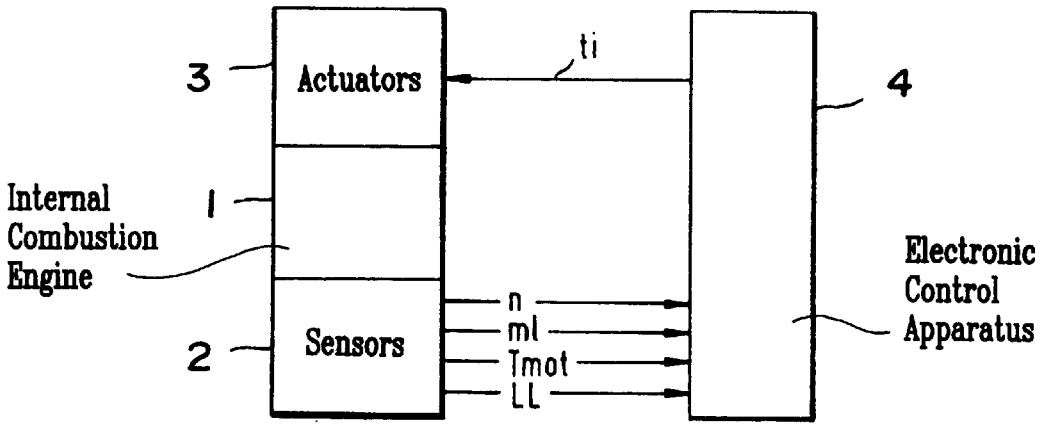
FIG. 1 shows the technical background of the invention in the form of function blocks.

Reference numeral 1 in FIG. 1 represents an internal combustion engine having sensor means 2, actuators 3 and an electronic control apparatus 4.

The sensor means include, for example, sensors for the engine rpm n, the air quantity ml inducted by the engine, the engine temperature Tmot, the idle position LL of a power actuator such as a throttle flap as well as other sensors, as required, for intake manifold pressure, inducted air temperature et cetera. The idle can, for example, be detected via an idle contact switch or also via the driver command detected via an accelerator pedal potentiometer.

From these signals, the control apparatus forms drive signals for the actuators of the engine such as the fuel-metering signals ti for driving the fuel-injection valves.

Figure 2:
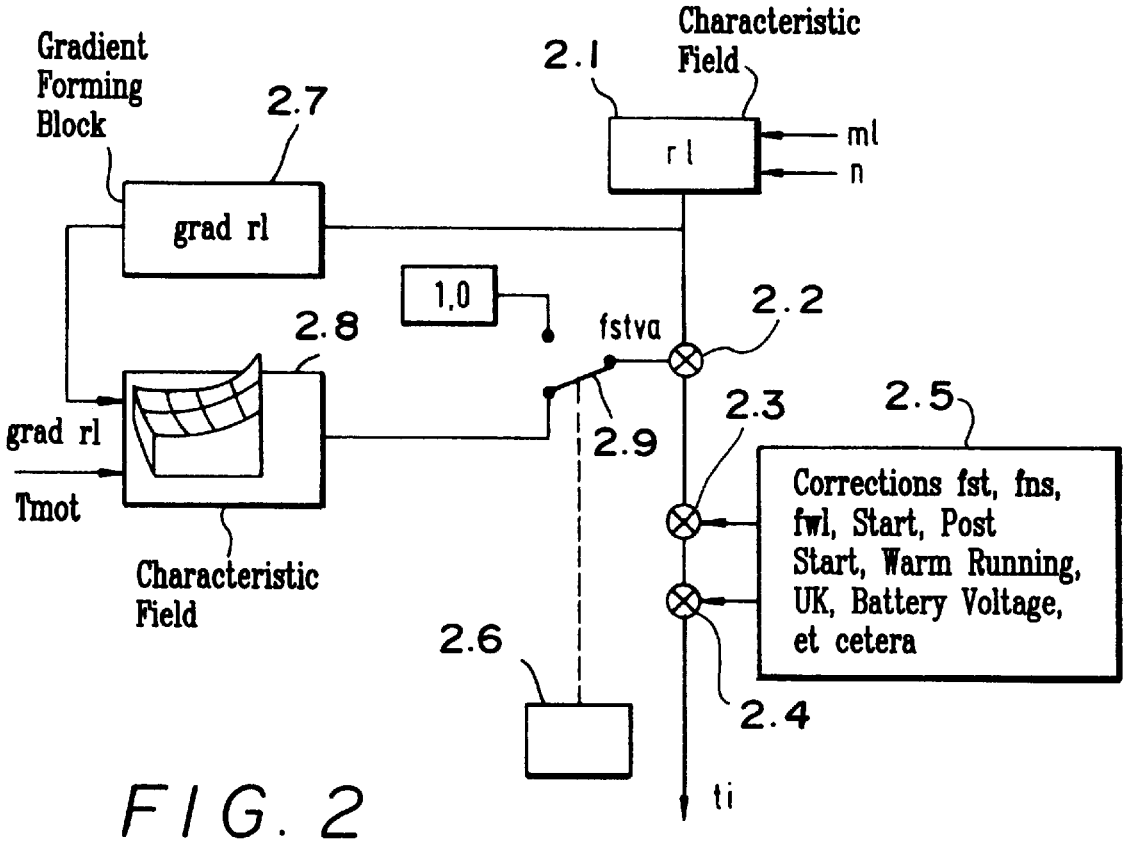
FIG. 2 is a schematic of an embodiment of the electronic control apparatus for forming a fuel-metering signal for an internal combustion engine.

FIG. 2 shows the formation of the fuel-metering signal ti in accordance with the invention.

Block 2.1 is a characteristic field and outputs a base value rl for the fuel-metering signal which, for example, can be determined as an inducted air quantity per stroke proportional to the quotient of ml and n.

This base value is multiplicatively and additively corrected in blocks 2.2 to 2.4 to the injection pulsewidth ti with which the injection valve(s) are driven. The blocks 2.3, 2.4 and 2.5 include the known corrections. Thus, the known start and post-start enrichment is, for example, multiplicatively pregiven. Likewise, the conversion of the air quantity rl into a fuel quantity takes place multiplicatively in a corresponding pulsewidth. A correction, which considers the battery voltage influences and, under some circumstances, also a transition compensation UK, works, for example, additively.

The intervention according to the invention takes place multiplicatively in block 2.2. Block 2.6 activates and deactivates the intervention according to the invention via the switch 2.9. The active state is shown. In the inactive state, the corrective quantity fstva has the value 1 and thereby produces no effect. In the active state, the gradient gradrl of the charge rl is formed in the block 2.7. A value fstva is determined, for example, by accessing a characteristic field 2.8 in dependence upon the value of the gradient gradrl and, if required, the engine temperature Tmot. The value fstva is less than 1 and therefore operates to reduce ti and so operates to effect a leaning.

Figure 3A:
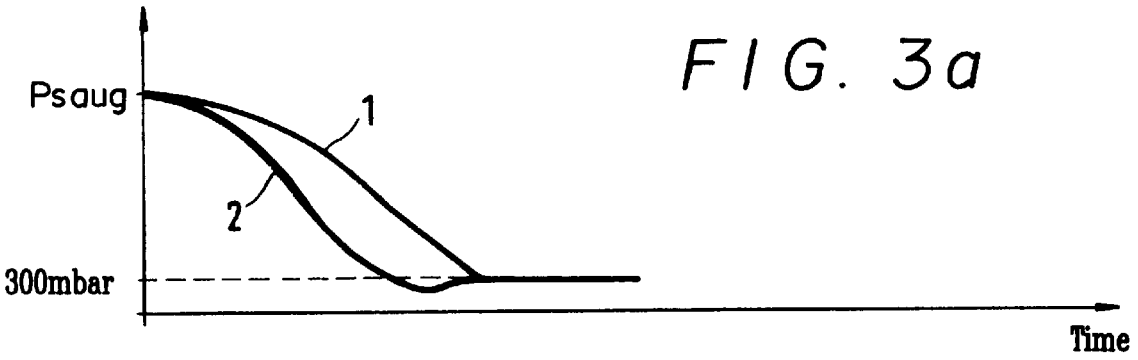
FIG. 3*a* shows the time-dependent trace of the intake manifold pressure in the first seconds of operation of the engine.
Figure 3B:
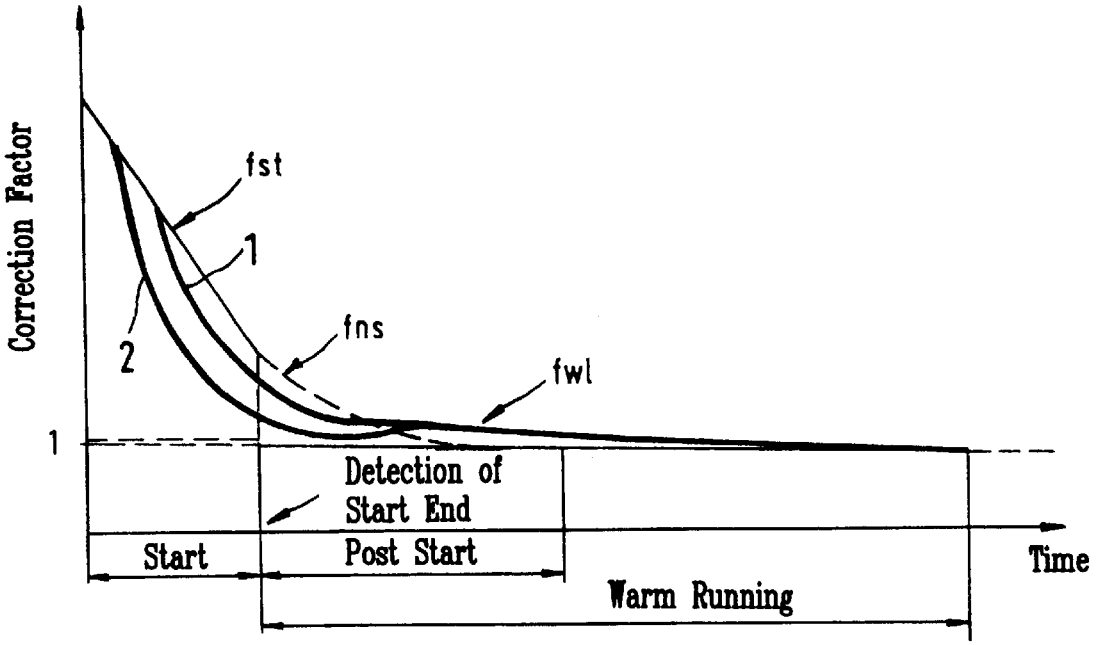
FIG. 3*b* the time-dependent trace of the enrichment with and without the action of the electronic control apparatus of the invention
Figure 3C:
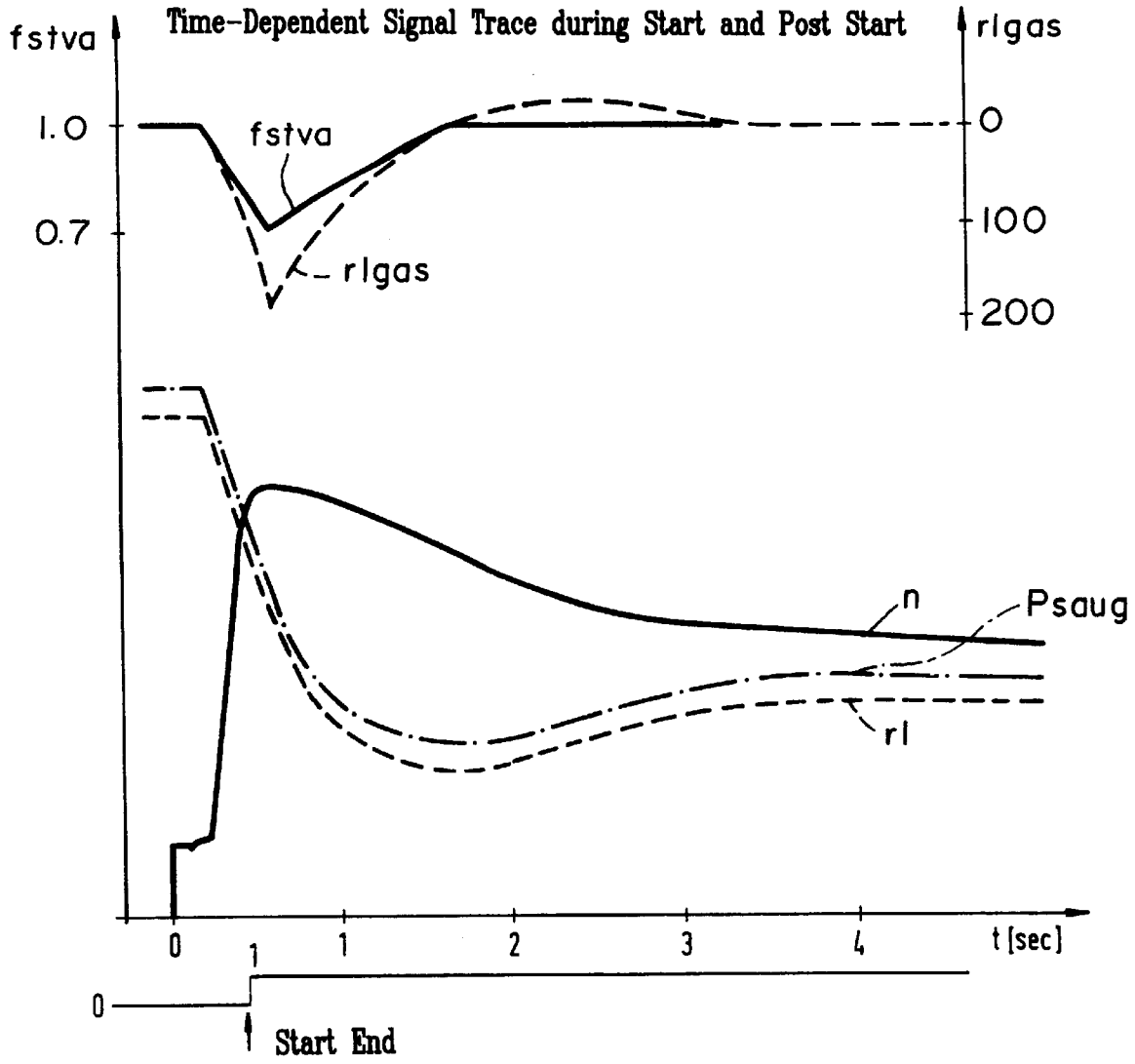
FIG. 3*c* is a set of curves showing the correlation of different engine operating parameters such as engine rpm, intake manifold pressure and a base value of a fuel-metering signal.

FIGS. 3*a* to 3*c* show the effect with the invention with respect to a time-dependent trace of the start and post-start corrections.

FIG. 3*a* shows the trace of the intake manifold pressure in the first seconds of operation of the engine and FIG. 3*b* shows the time-dependent trace of the enrichment without and with the effect of the invention. FIG. 3*c* shows the correlation of different engine operating parameters such as rpm n, intake manifold pressure psaug and base value rl of a fuel-metering signal to the factor fstva according to the invention and to the gradient rlgas of the cylinder charge and/or of the base value rl. The value rlgas defines a measure for the trace of the intake manifold pressure. The gradient rlgas corresponds to the value identified as gradrl at another location and can, for example, be determined via a work cycle of the engine from the cylinder charge rl.

As shown in FIG. 3*b*, during the entire start operation, a special computation of the injection quantity of the injection timing is provided because, during the start phase of the engine, significantly different fuel masses generally have to be metered than in normal engine operation. Here, different demands result which are dependent upon engine temperature and fuel temperature in order to make possible a reliable start. An increase in injection quantity functions to build up the fuel film on the intake manifold wall and cylinder wall and covers the increased fuel requirement while the engine rpm increases. The factor fst serves this buildup. The start factor fst permits a temperature-dependent adaptation of the fuel quantity, which is to be injected, in order to meter an adequate amount of fuel for the buildup of the wall film during the first injection pulses.

The adaptation, which is introduced via the factor fst should be effective exclusively in the start phase of the engine. For this reason, the start adaptation is withdrawn when the end of the start is detected. The start factor fst then assumes the value 1. The factor fst is thereby directly coupled to the start recognition which takes place via a lower and/or upper limit rpm.

Directly after the first rotations of the engine, that is, after the start begin, the start additional quantity is controlled down in dependence upon the increasing rpm of the engine up to the start end. During the post-start phase, that is, during the first seconds after start end, a further reduction of the still increased injection quantity is provided in dependence upon the engine temperature and time after start end. The factor fns is active in the post-start phase.

In a manner similar to the requirements in the start phase of the engine, a special adaptation of the fuel quantity, which is to be injected, to the actual engine state must also still take place after the detection of the start end. Interventions in the post-start phase serve to compensate changes of the mixture composition because of wall film effects. This task is assumed by a correction factor fns with the objective to achieve a stoichiometric mixture in the combustion chamber in the post-start phase. Here, the greater correction or lesser correction can be adjusted via load-dependent and temperature-dependent characteristic fields. The correction factor fns is reduced to the neutral value 1 in advance of reaching the normal operating temperature.

The post-start phase moves evenly into warm running in which a factor fwl is active. After ending the warm running, the factors fst, fns and fwl each have the value 1.

In FIG. 3*a*, reference numeral 1 identifies the trace of the intake manifold pressure during the start of the engine and reference numeral 2 identifies the intake manifold pressure trace directly after the start of the engine. Before the start, ambient pressure is present in the intake manifold, that is, approximately 1000 mbar. An intake manifold pressure value of approximately 300 mbar adjusts for a running engine at idle with the throttle flap closed. The gradient, that is, the slope of curves (1, 2) greatly influences the vaporization from the wall film and is considered in accordance with the invention in the start and post-start phases for the formation of the fuel-metering signal. The steeper the curve is, the more intense is the vaporization of the fuel from the wall film.

According to the invention, a consideration of this effect takes place via a supplementary correction of the fuel-metering signal which acts in the leaning direction. The steeper the intake manifold pressure curve runs, the smaller is the supplementing factor from the characteristic field 2.8

The operation of this correction is defined by the lines 1 and 2 in FIG. 3*b*. These lines correspond to the value of the corrective factor with the supplementing correction via the factor fstva which is always less than or equal to 1. Here, a correction which acts with greater effect in the leaning direction results for a steeper gradient in FIG. 3*a*. The curve 1 shown dotted in FIG. 3*b* corresponds to the curve 1 in FIG. 3*a*. The curves identified by reference numeral 2 in FIGS. 3*a* and 3*b* correspond in a like manner.

Figure 4:
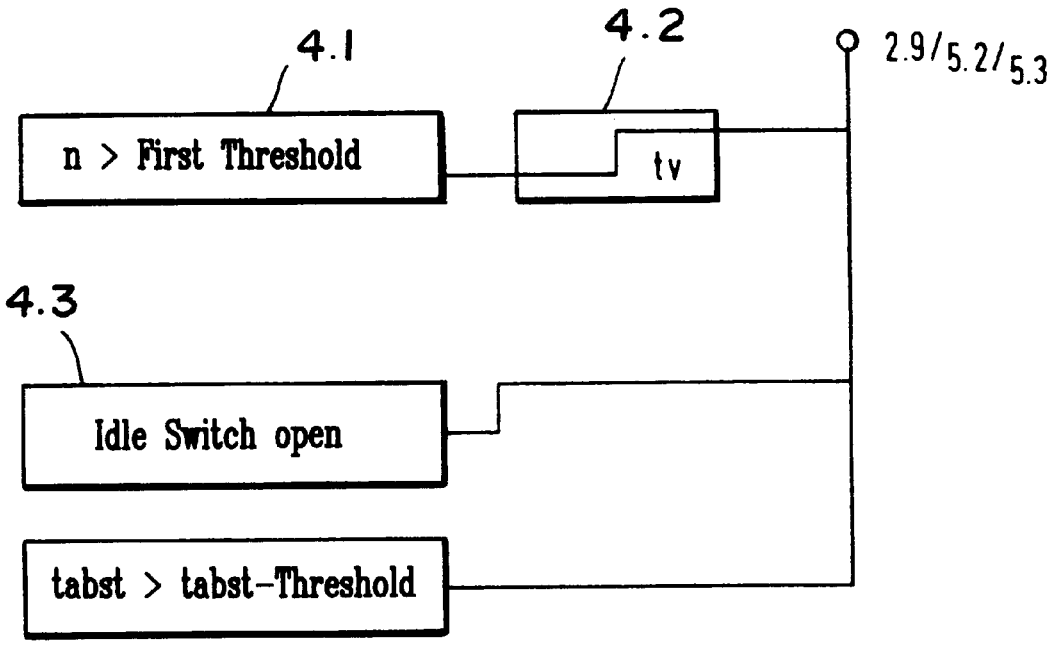
FIG. 4 is a schematic block diagram showing an embodiment of the deactivation conditions; and, FIG. 5 is a schematic showing how the correction is guided continuously to the value 1 when switching off the engine.

The supplementing leaning correction is intended to be active only in the first seconds of engine operation. FIG. 4 shows an embodiment of deactivation conditions. Thus, the correction, for example, is interrupted after the elapse of the determined time delay after the start end. The start end is defined by reaching a first rpm threshold after actuating the starter. Block 4.1 serves this purpose. The predetermined time delay tv in block 4.2 is preferably 1 to 3 seconds.

As an alternative, the function is deactivated when there is a movement out of idle within the first seconds after the start; this can, for example, be determined by opening an idle switch in block 4.3. This is typically the case when the driver actuates the accelerator pedal. The then opening throttle flap has, as a consequence, an increase in intake manifold pressure or a slowing of the intake-manifold pressure drop. The supplementing correction according to the invention is then not necessary.

The function is not even activated when the deactivation time tabst of the engine exceeds a predetermined threshold value tabst-threshold. In this case, no wall film reduction is present which could disturb the known start corrections.

It is also advantageous to provide for a continuous reduction of the supplementing correction in order to avoid torque jumps because of jump-like deactivations. A continuous reduction can be achieved in that the correction fstv is continuously brought to the value 1 when deactivating.

Figure 5:
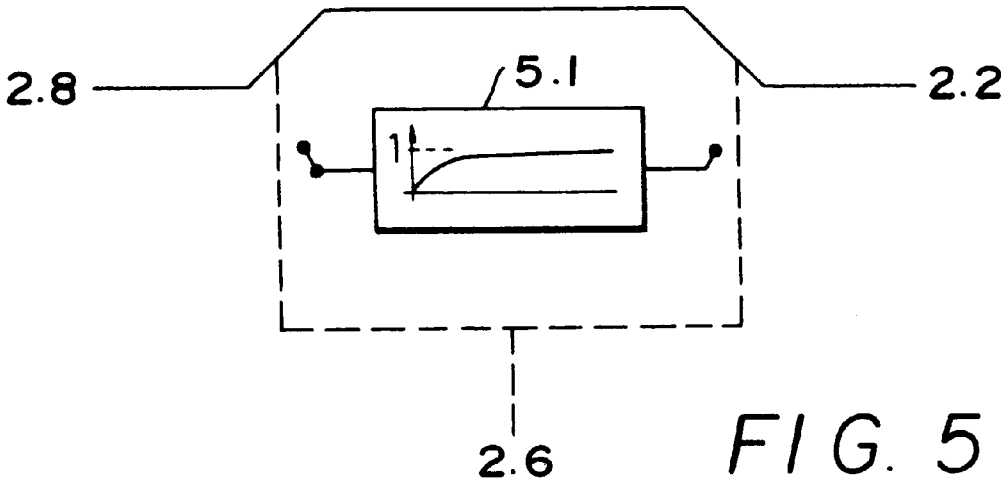

The above is shown in FIG. 5. As long as the deactivation conditions are not present, the switches 5.2 and 5.3 are in the position shown so that the factor fstva operates without change on the formation of the injection time in block 2.2. When, in contrast, the deactivation conditions are satisfied, the switches 5.2 and 5.3 are actuated and the factor fstva is supplied to block 5.1. Block 5.1 processes its input signal continuously to a value 1; that is, the input signal is initially at the output of block 5.1. In the further course, this input signal is lead continuously to the value 1, for example, in accordance with an e-function.

It is understood that the foregoing description is that of the preferred embodiments of the invention and that various changes and modifications may be made thereto without departing from the spirit and scope of the invention as defined in the appended claims.

What is claimed is:

1. An electronic control apparatus for forming a fuel-metering signal for an internal combustion engine wherein increased fuel metering occurs during and after a start of said engine, said engine having an intake manifold wherein pressure is developed during operation of said engine, the electronic control apparatus comprising:

means for forming an index for the pressure in the intake manifold of said engine;

means for forming the gradient of said index;

means for reducing the increased metering of fuel in dependence upon said gradient; and, means for deactivating the reduction of said increased fuel metering when the turn-off time of said engine prior to said start exceeds a pregiven threshold value.

2. The electronic control apparatus of claim 3, further comprising:

means for detecting a temperature in the region of said engine; and, means for additionally reducing said increased fuel metering in dependence upon said temperature.

3. The electronic control apparatus of claim 1, wherein said reduction is deactivated after said start when a first rpm threshold is exceeded and triggers a delay time (tv) and said delay time (tv) has elapsed.

4. The electronic control apparatus of claim 1, comprising means for causing said reduction to take place via a supplemental multiplicative correction of the fuel metering; and, means for guiding said supplemental multiplicative correction continuously to the value 1 when deactivating said reduction.

5. An electronic control apparatus for forming a fuel-metering signal for an internal combustion engine wherein increased fuel metering occurs during and after a start of said engine, said engine having an intake manifold wherein pressure is developed during operation of said engine, the electronic control apparatus comprising:

means for forming an index for the pressure in the intake manifold of said engine;

means for forming the gradient of said index;

means for reducing the increased metering of fuel in dependence upon said gradient; and, means for suspending the reduction when there is a movement out of idle operation.

6. An electronic control apparatus for forming a fuel-metering signal for an internal combustion engine wherein increased fuel metering occurs during and after a start of said engine, said engine having an intake manifold wherein pressure is developed during operation of said engine, the electronic control apparatus comprising:

means for forming an index for the pressure in the intake manifold of said engine;

means for forming the gradient of said index;

means for reducing the increased metering of fuel in dependence upon said gradient;

said engine inducting an air quantity (ml) and the cylinders of said engine inducting a cylinder charge during operation thereof;

means for deriving said index for the intake manifold pressure from at least one of the following: a signal as to the intake air quantity (ml) and the cylinder charge of the engine; and, means for utilizing a base value (rl) for the fuel-metering signal as an index for the intake manifold pressure.

7. The electronic control apparatus of claim 6, wherein said engine inducts an air quantity (ml); and, said base value (rl) is an air quantity which is inducted per stroke which is proportional to the quotient of the inducted air quantity (ml) and engine rpm (n).

* * * * *

UNITED STATES PATENT AND TRADEMARK OFFICE

CERTIFICATE OF CORRECTION

PATENT NO. : 6,220,225 B1 
DATED : April 24, 2001
INVENTOR(S) : Bernhard Mencher and Gunter Mueller It is certified that error appears in the above-identified patent and that said Letters Patent is hereby corrected as shown below:

Column 5,
Line 57, delete "claim 3" and substitute -- claim 1 -- therefor.

Signed and Sealed this

Eleventh Day of March, 2003

JAMES E. ROGAN
*Director of the United States Patent and Trademark Office*